United States Patent [19]

Murphy

[11] Patent Number: 4,800,032

[45] Date of Patent: Jan. 24, 1989

[54] ALIPHATIC HYDROCARBON SUBSTITUTED AROMATIC HYDROCARBONS TO CONTROL BLACK SLUDGE IN LUBRICANTS

[75] Inventor: John P. Murphy, Willoughby, Ohio

[73] Assignee: The Lubrizol Corporation, Wickliffe, Ohio

[21] Appl. No.: 71,003

[22] Filed: Jul. 8, 1987

[51] Int. Cl.[4] ..... C10M 133/44; C10M 127/06

[52] U.S. Cl. ..... 252/51.5 A; 585/4; 585/11; 585/25; 585/26

[58] Field of Search ..... 585/4, 11, 25, 26; 252/51.5 A

[56] References Cited

U.S. PATENT DOCUMENTS

| | | | |
|---|---|---|---|
| 2,249,317 | 7/1941 | Luber | 585/26 |
| 2,355,993 | 8/1945 | Morgan | 585/4 |
| 2,387,170 | 10/1945 | Morgan | 585/4 |
| 2,491,120 | 12/1949 | Loane | 585/11 |
| 2,913,412 | 11/1959 | Moore | 585/11 |
| 3,002,913 | 10/1961 | Pino | 585/11 |
| 3,066,101 | 11/1962 | Wilgus | 585/11 |
| 3,288,716 | 11/1966 | Becraft et al. | 585/4 |
| 3,338,877 | 8/1967 | Anderson | 585/4 |
| 3,510,428 | 5/1970 | Didden et al. | 252/48.2 |
| 3,600,451 | 8/1971 | Rowe | 585/11 |
| 3,661,780 | 5/1972 | Feighner | 585/26 |
| 3,725,280 | 4/1973 | Durr, Jr. et al. . | |
| 3,775,325 | 11/1973 | Kerfoot et al. . | |
| 3,808,134 | 4/1974 | Romine . | |
| 3,812,035 | 5/1974 | Krenowicz et al. . | |
| 3,812,036 | 5/1974 | Romine | 585/4 |
| 3,834,166 | 9/1974 | Cupper et al. | 585/4 |
| 3,994,815 | 11/1976 | Coleman . | |
| 4,320,021 | 3/1982 | Lange | 44/58 |
| 4,604,491 | 8/1986 | Dressler et al. | 585/25 |

FOREIGN PATENT DOCUMENTS 0180848 5/1986 European Pat. Off. .

OTHER PUBLICATIONS

"Tank Insel, Zeitschrift für BP-Tankstellen", No. 6, Nov.-Dec. 1986, pp. 16-17 (with translation copy).

Product Brochure Lubrizol® 7462, "Doing More With Less", 1986.

*Primary Examiner*—Jacqueline V. Howard

*Attorney, Agent, or Firm*—Joseph P. Fischer; Robert A. Franks; James L. Cordek

[57] ABSTRACT

A lubricating oil composition comprising a major amount of an oil of lubricating viscosity and a minor amount, effective to inhibit the accumulation of black sludge in a gasoline fueled internal combustion engine, of an aliphatic hydrocarbon substituted aromatic hydrocarbon. The aliphatic hydrocarbon substituted aromatic hydrocarbon comprises a compound of the formula $$Ar—R—(Ar)_n$$

wherein each Ar is independently an aromatic nucleus having from 0 to 3 substituents, R is a hydrocarbyl group, and n is an integer ranging from 1 to about 6. In a further embodiment, the aliphatic hydrocarbon substituted aromatic hydrocarbon further comprises from about 1 to about 50 percent by weight of tetrahydronaphthalene or hydrocarbyl substituted tetrahydronaphthalenes.

19 Claims, No Drawings

ALIPHATIC HYDROCARBON SUBSTITUTED AROMATIC HYDROCARBONS TO CONTROL BLACK SLUDGE IN LUBRICANTS

FIELD OF THE INVENTION

This invention relates to a method for controlling deposit formation and accumulation of deposits on parts of a gasoline fueled internal combustion engine which are exposed to lubricating oil. In particular, it relates to a method for controlling a new type of deposit referred to as "black sludge" by lubricating the internal combustion engine with a lubricating oil which has incorporated therein an effective amount of certain aliphatic hydrocarbon substituted aromatic hydrocarbons.

BACKGROUND OF THE INVENTION

Over the years deposit formation in internal combustion engines has been a continuing problem. The amount of deposit formation had been controlled to some extent by the use of antioxidants and metal salts, particularly highly basic metal salts, of various organic acids. While these efforts provided some benefit, a particularly troublesome type of deposit referred to as "sludge" continued to form in internal combustion engines. This sludge accumulated on the various internal parts of the engine and caused sluggish operation, increased wear and sometimes resulted in blocked oil passages resulting in extensive wear and/or failure of the engine. The only way known to control accumulation of harmful amounts of sludge was to change the engine oil at frequent intervals, usually every 30 days or every 1,000 miles of operation.

By the late 1950's and early 1960's, additives were developed which were found to control sludge formation. These additives, generally referred to as "ashless dispersants", and refinements thereof, revolutionized lubricant additive chemistry and resulted in the ability to extend oil change intervals to up to as long as one year of more.

Recently, and particularly in Europe, a new type of engine deposit has been observed. This deposit is sometimes referred to as "black sludge" or "German sludge" because it was first observed in Germany. Black sludge causes operational problems similar to those observed with the earlier observed sludge formation. Conventional engine oil additives, including the ashless dispersants, have not effectively controlled formation and/or accumulation of black sludge. Accordingly, a method for controlling the formation and/or accumulation of black sludge in an internal combustion engine would be of considerable value.

SUMMARY OF THE INVENTION

This invention provides lubricating oil compositions which provide a means for inhibiting or controlling the formation and accumulation of black sludge in gasoline fueled internal combustion engines. This is accomplished by incorporating into a lubricating oil composition which allows the accumulation of black sludge in a gasoline fueled internal combustion engine, a minor amount, effective to inhibit the formation or accumulation of black sludge in said engine, of an aliphatic hydrocarbon substituted aromatic hydrocarbon. The aliphatic hydrocarbon substituted aromatic hydrocarbon comprises a composition of the formula $$Ar—R—(Ar)_n \quad (I)$$

wherein each Ar is independently an aromatic nucleus having from 0 to 3 substituents, R is a hydrocarbyl group, and n is an integer ranging from 1 to about 6, with the proviso that n does not exceed the available valences of R. In a further embodiment, the aliphatic hydrocarbon substituted aromatic hydrocarbon further comprises from about 1 to about 50 percent, often from about 2 to about 25 percent by weight of tetrahydronaphthalene or hydrocarbyl substituted tetrahydronaphthalenes. Also provided is a method for inhibiting the accumulation of black sludge in an internal combustion engine, which method comprises lubricating said internal combustion engine with a lubricating oil composition containing a minor amount effective to inhibit the accumulation of black sludge in said engine, of the above-described aliphatic hydrocarbon substituted aromatic hydrocarbon.

DETAILED DESCRIPTION OF THE INVENTION

As mentioned hereinabove, the present invention relates to improvements in lubricating oil compositions which otherwise allow the accumulation of black sludge in a gasoline fueled internal combustion engine. Gasoline fueled engines employ as the operating fuel automotive gasoline meeting the specifications given in American Society for Testing and Materials Specification D-439, "Standard Specification for Automotive Gasoline", which is expressly incorporated herein by reference.

BLACK SLUDGE

The formation and accumulation of black sludge in gasoline fueled engines, is a relatively recently observed phenomenon. Black sludge appears to be quite different from the sludge usually encountered in a gasoline fueled internal combustion engine, for example, that generated in the Sequence V-D test under low temperature operating conditions. It is similar in appearance to the sludge formed in a diesel engine. Black sludge appears to occur mainly under high temperature oxidizing conditions. It is deposited primarily on the valve deck, rocker cover and other cooler engine parts. The deposits are often hard and resinous. Workers have suspected that it is possibly related to certain lubricant base stocks and/or fuels, although no definitive data is available at the present time. Black sludge accumulation has been observed primarily in gasoline fueled internal combustion engines used in the Euorpean market. It is unusual for such formations to appear in gasoline engines. Sludge usually found in a gasoline engine is lead sludge, sludge containing combustion by-products, and emulsion sludge which contains water and other products. The formation and/or accumulation of sludge, other than black sludge, in a gasoline engine is usually readily controlled by the use of ashless dispersants such as succinimide dispersants, ester dispersants, Mannich type dispersants and other ashless dispersants.

Black sludge appears to be quite different from the sludge usually encountered in a gasoline fueled engine. Black sludge is also sometimes referred to as nitrate sludge or high temperature sludge. It has been often observed that there is a high content of organic nitrates in used oil containing black sludge. As is well known, organic nitrates are formed in an engine during combustion of gasoline fuel with air. Nitrogen in the air forms nitrogen oxides ($NO_x$). A discussion of black sludge, including a description, photographs, theories regarding its formation and the like, appears in the house organ for German BP filling stations entitled "Tank Insel", Zeitschrift für BP Tankstellen, #6, November–December, 1986, pages 16–17. This publication indicates that solutions to the black sludge problem do exist, but only describes the solutions in terms of commercial brand name oils. A further discussion of black sludge appears in the newsletter entitled "the LUBRIZOL NEWSLINE TM", Vol 4, No 1, April, 1986. Each of the above mentioned publications is expressly incorporated herein by reference.

ALIPHATIC HYDROCARBON SUBSTITUTED AROMATIC HYDROCARBON

Aliphatic hydrocarbon substituted aromatic hydrocarbons useful in the compositions and methods of this invention are well known in the art. They can be represented by the formula $$Ar—R—(Ar)_n \quad (I)$$

wherein each Ar is independently an aromatic nucleus having from 0 to 3 substituents, R is a hydrocarbyl group, and n is an integer ranging from 0 to about 6, with the proviso that n does not exceed the available valences of R. The aliphatic hydrocarbon substituted aromatic hydrocarbon useful in this invention comprises a compound of formula (I) wherein n=1 to 6.

Ar may be a single ring aromatic nucleus, such as a benzene ring, a polynuclear fused ring aromatic, such as naphthyl or a higher fused aromatic moiety or a linked aromatic nucleus wherein two aromatic groups as described hereinabove are linked by a bridging linkage individually chosen from single bonds linking carbon atoms in the aromatic nuclei, lower alkylene linkages, ether linkages, sulfide or polysulfide linkages, lower alkylene ether linkages, and the like. Examples of aromatic nuclei are described at length in U.S. Pat. No. 4,320,021, which patent is expressly incorporated herein by reference for relevant disclosures contained therein.

Substituents on Ar may be any group that does not significantly detract from the essentially hydrocarbon nature of Ar. Such substituents may include, but are not necessarily limited to, hydrocarbyl, halo, lower hydrocarbyloxy, lower hydrocarbylthio, and the like. Preferred substituents are hydrocarbyl groups, especially alkyl or alkenyl groups, having from about 6 to about 30 carbons. In a preferred embodiment, the aromatic group Ar is a benzene ring which may be unsubstituted or which may contain from 1 to 3 substituents. Often Ar has an average of from 0 to 1 substituents. The substituents referred to hereinabove do not include the substituent R in formula (I).

It is to be noted that when the term "hydrocarbyl" or "hydrocarbon" is used in describing a group or substituent in this specification and the appended claims, it is also intended to embrace substantially hydrocarbyl groups or substituents unless expressly groups or substituents are those which are substituted with non-hydrocarbyl groups which do not substantially affect the hydrocarbyl nature or character or the group or substituent in the context of the invention and which would, therefore, be considered to be within the scope of the terms "hydrocarbyl" or "hydrocarbon" by the skilled worker in the art. For example, it is obvious that, in the context of this invention, a $C_{30}$ hydrocarbyl substituent and a $C_{30}$ hydrocarbyl substituent substituted with a methylmercapto or methoxy group would be substantially similar in their properties with regard to their use in this invention, and would, in fact, be recognized as equivalents in the context of this invention by one of ordinary skill in the art.

In general, when such non-hydrocarbyl groups are present within a group or substituent or as a substituent on any such group or substituent, there will be no more than two such non-hydrocarbyl groups for each ten carbon atoms in the hydrocarbyl or hydrocarbon group or substituent; preferably not more than one for each ten carbon atoms. Generally, however, unless expressly stated otherwise, it is preferred that no such non-hydrocarbyl groups be present and that the hydrocarbyl or hydrocarbon groups or substituents be solely hydrocarbon in nature.

THE ALIPHATIC HYDROCARBON SUBSTITUENT

The aromatic hydrocarbon useful in the lubricating oil compositions and methods of this invention contain one or more aliphatic hydrocarbon substituents. When the aliphatic hydrcarbon substituted aromatic hydrocarbon comprises a single aromatic moiety, the aromatic moiety will be substituted by at least one aliphatic hydrocarbon substituent. That is, the aliphatic hydrocarbon substituted aromatic hydrocarbon will have the general formula $$Ar—R—(Ar)_n \quad (I)$$

wherein Ar is as defined hereinabove, n is 0 and R is an aliphatic hydrocarbon group. In this case, R is preferably an alkyl or alkenyl group.

It is readily apparent that, depending on the value of n, R will be a mono- or poly-valent group. As mentioned hereinabove, when n is 0 and R is an aliphatic hydrocarbon group. In this case, R is preferably an alkyl or alkenyl group.

It is readily apparent that, depending on the value of n, R will be a mono- or poly-valent group. As mentioned hereinabove, when n is 0, R is an essentially mono-valent hydrocarbon substituent on Ar. As mentioned hereinabove, the aliphatic hydrocarbon substituted aromatic hydrocarbon comprises at least one percent by weight of a compound of formula (I) wherein n is an integer ranging from 1 to about 6 with the proviso that n does not exceed the available valences of R. Accordingly, when n is 1, R is a divalent group, when n is 2, R is a trivalent group and so on, provided that n does not exceed the available valences of R.

As discussed hereinabove for hydrocarbon or hydrocarbyl groups or substituents, R may contain non-hydrocarbyl substituents, provided that they do not detract from the essentially hydrocarbon or hydrocarbyl character of R. Preferably, R is a hydrocarbyl group containing from about 6 to about 30 carbons, more preferably about 8 to about 15 carbons.

In another embodiment, the aliphatic hydrocarbon substituted aromatic hydrocarbon may comprise or may be a composition having the formula

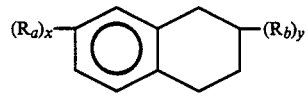

(II)

wherein each $R_a$ and $R_b$ is independently a hydrocarbyl group having from 1 to about 30 carbon atoms, x and y are each independently an integer from 0 to 4, preferably 1 to 3, more preferably 1 to 2. These compounds are referred to as tetrahydronaphthalene, hydrocarbyl substituted tetrahydronaphthalenes or tetralins.

The aliphatic hydrocarbon substituted aromatic hydrocarbon may comprise a mixture of two or more of the above-discussed components. That is, the aliphatic hydrocarbon substituted aromatic hydrocarbon may contain mixtures of materials of formula $$Ar—R—(Ar)_n \quad (I),$$

and may contain compounds of formula (II). For example, the aliphatic hydrocarbon substituted aromatic hydrocarbon may be a mixture of components of Formula (I) wherein the various components each have similar Ar groups, but n may be 0 or 1, but at least one percent by weight will be a compound of formula (I) wherein n is at least 1, and R will, depending on n, be an alkyl or alkylene group having, for example, 8 to about 14 carbon atoms.

In general, the aliphatic hydrocarbon substituted aromatic hydrocarbon comprises from about 1 to about 75 percent, preferably from about 5 percent to about 50 percent by weight of a composition of formula $$Ar—R—(Ar)_n \quad (I)$$

wherein each Ar is independently an aromatic nucleus having from 0 to 3 substituents, R is a hydrocarbyl group, and n is an integer ranging from 1 to about 6, with the proviso that n does not exceed the available valences of R.

As mentioned hereinabove, the aliphatic hydrocarbon substituted aromatic hydrocarbon may comprise a component having the formula (II). In a more likely situation, the aliphatic hydrocarbon substituted aromatic hydrocarbon may comprise from about 1 percent to about 50 percent, preferably from about 2 percent to about 20 percent by weight of tetrahydronaphthalene or hydrocarbyl substituted tetrahydronaphthalenes.

Frequently, the aliphatic hydrocarbon substituted aromatic hydrocarbon will comprise a mixture of various types of the above-described components.

In an especially preferred embodiment, the aliphatic substituted aromatic hydrocarbon comprises a composition wherein at least one Ar in Formula I is a benzene ring having from 0 to about 3 substituents. Particularly preferred is when the aliphatic hydrocarbon substituted aromatic hydrocarbon contains at least 10 percent by weight, more preferably at least 25 percent by weight of a compound of formula (I) where n is 1 or 2, most preferably 1.

SOURCES OF ALIPHATIC HYDROCARBON SUBSTITUTED AROMATIC HYDROCARBON

Aliphatic hydrocarbon substituted aromatic hydrocarbons useful in the compositions and methods of this invention are well known in the art and can be prepared by alkylation of aromatic compounds such as benzene, toluene, naphthalene, anthracene and the like. Generally, the aliphatic hydrocarbon substituted aromatic hydrocarbons can be prepared by alkylation of aromatic compounds with halogenated aliphatic hydrocarbons or with olefins. Procedures for preparing such compositions are well known and are described in the following patents and publications:

Kirk and Othmer, "Encyclopedia of Chemical Technology", Third Edition, Volume II, "Alkylation", pages 50–51, 58–65, John Wiley and Sons (1978), U.S. Pat. Nos. 1,815,022; 1,878,262; 1,963,917; 1,963,918; 2,015,748; 2,030,307; 2,475,970; 2,688,643; 2,810,769; 2,882,289; 3,104,267; 3,316,294; 3,775,325; West German Application No. 3,440,196.

In a preferred embodiment of this invention, the aliphatic hydrocarbon substituted aromatic hydrocarbon comprises from about 20 to about 50 percent by weight, but may comprise as little as 1 percent by weight or up to 100 percent by weight, of a compound of the formula $$Ar—R—(Ar)_n \quad (I)$$

wherein each Ar is independently an aromatic nucleus having from 0 to 3 substituents, R is a hydrocarbyl group, and n is an integer ranging from 1 to about 6, with the proviso that n does not exceed the available valences of R. Commercially available products contain a wide range of compounds of formula (I). Several contain from about 10 to about 20 percent by weight, another contains about 36 percent by weight of the aliphatic hydrocarbon substituted aromatic composition wherein n is an integer from 1 to 6. Usually n equals 1. These compounds are obtained in varying amounts depending on reaction conditions. These preferred compounds are obtained when the alkylating agent is or contains a di-or polyfunctional compound such as a di- or polychlorinated wax. As discussed in several of the above references, the amount of such compounds obtained during an alkylation process depends on numerous factors including, but not limited to, the amount of di- and polyhalogenated reactant, relative amounts of reactants and the like.

Tetrahydronaphthalene and alkylated versions thereof can also be formed during the alkylation of aromatic compounds.

Many materials useful in the compositions and methods of this invention are commercially available. Examples include detergent alkylates from numerous sources, Wibarco Heavy Alkylate (Chemicale Fabrik Wibarco GmbH, West Germany) and Vista 3050 specialty alkylate (Vista Chemical company, Baltimore, Md.

THE OIL OF LUBRICATING VISCOSITY

The lubricating compositions and methods of this invention employ an oil of lubricating viscosity, including natural or synthetic lubricating oils and mixtures thereof.

Natural oils include animal oils and vegetable oils (e.g. castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils, alkylated diphenyl ethers and alkylated diphenyl sulfides.

Alkylene oxide polymers and interpolymers and derivatives thereof where the terminal hydroxyl groups have been modified by esterification, etherification, etc., constitute another class of known synthetic lubricating oils that can be used.

Another suitable class of synthetic lubricating oils that can be used comprises the esters of dicarboxylic acids with a variety of alcohols (e.g., butyl alcohol, dodecyl alcohol, ethylene glycol, diethylene glycol monoether, etc.).

Esters useful as synthetic oils also include those made from $C_5$ to $C_{12}$ monocarboxylic acids and polyols and polyol ethers.

Silicon-based oils such as the polyalkyl-, polyaryl-, polyalkoxy-, or polyaryloxy-siloxane oils and silicate oils comprise another useful class of synthetic lubricants. Other synthetic lubricating oils include liquid esters of phosphorus-containing acids, polymeric tetrahydrofurans and the like.

Unrefined, refined and rerefined oils, either natural or synthetic (as well as mixtures of two or more of any of these) of the type disclosed hereinabove can be used in the compositions of the present invention. Unrefined oils are those obtained directly from a natural or synthetic source without further purification treatment. Refined oils are similar to the unrefined oils except they have been further treated in one or more purification steps to improve one or more properties. Many such purification techniques are known to those skilled in the art such as solvent extraction, secondary distillation, hydrorefining, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Specific examples of the above-described oils of lubricating viscosity are given in Chamberlin III, U.S. Pat. No. 4,326,972 and European Patent Publication No. 107,282, both of which are hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

OTHER ADDITIVES

The compositions of this invention may contain other components. The use of such additives is optional and the presence thereof in the compositions of this invention will depend on the particular use and level of performance required. The compositions may comprise a zinc salt of a dithiophosphoric acid. Zinc salts of dithiophosphoric acids are often referred to as zinc dithiophosphates, zinc 0,0-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and anti-oxidancy performance.

In addition to zinc salts of dithiophosphoric acids discussed hereinabove, other additives that may be used in the lubricating oils of this invention include, for example, detergents, dispersants, oxidation inhibiting agents, pour point depressing agents, extreme pressure agents, anti-wear agents, color stabilizers and anti-foam agents.

Auxiliary extreme pressure agents and corrosion and oxidation inhibiting agents which may be included in the compositions of the invention are exemplified by chlorinated aliphatic hydrocarbons such as chlorinated wax, organic sulfides and polysulfides such as benzyldisulfide, bis(chlorobenzyl)disulfide, dibutyltetrasulfide, and sulfurized alkylphenol. Also contemplated are phosphorus esters.

Viscosity improvers (also sometimes referred to as viscosity index improvers) are additives which improve the viscosity-temperature characteristics of oils. Such additives are often included in the compositions of this invention. Viscosity improvers are usually polymers, including polymethacrylic acid esters, diene polymers, polyalkyl styrenes, alkenylarene-conjugated diene copolymers and polyolefins. Multifunctional viscosity improvers which also have dispersant and/or antioxidancy properties are known. Such products are described in numerous publications including Dieter Klamann, "Lubricants and Related Products", Verlag Chemie Gmbh (1984), pp 185–193; C. V. Smalheer and R. K. Smith, "Lubricant Additives", Lezius-Hiles Co (1967); M. W. Ranney, "Lubricant Additives", Noyes Data Corp. (1973), pp 92–145; M. W. Ranney, "Lubricant Additives, Recent Developments", Noyes Data Corp (1978), pp 139–164; and M. W. Ranney, "Synthetic Oils and Additives for Lubricants", Noyes Data Corp. (1980), pp 96–166. Each of these publications is hereby expressly incorporated by reference.

Pour point depressants are a particularly useful type of additive often included in the lubricating oils described herein. The use of such pour point depressants and oil-based compositions to improve low temperature properties of oil-based compositions is well known in the art. See for example, page 8 of "Lubricant Additives" by C. V. Smallheer and R. Kennedy Smith (Lezius-Hiles Company Publishers, Cleveland, Ohio, 1967). Pour point depressants useful for the purpose of this invention, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures.

Anti-foam agents are used to reduce or prevent the formation of stable foam. Typical anti-foam agents include silicone or organic polymers. Additional anti-foam compositions are described in "Foam Control Agents", by Henry T. Kerner (Noyes Data Corporation, 1976), pages 125–162, which is expressly incorporated herein by reference.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by at least one direct carbon-to-phosphorus linkage.

The term "basic salt" is used to designate metal salts wherein the metal is present in stoichiometrically large amounts than the organic acid radical. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a non-volatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Pat. No. 1,306,529 and in many U.S. patents including the following which are expressly incorporated herein by reference:

U.S. Pat. Nos. 3,163,603; 3,351,552; 3,541,678; 3,172,892; 3,381,022; 3,542,680; 3,184,474; 3,399,141; 3,567,637; 3,215,707; 3,415,750; 3,574,101; 3,219,666; 3,433,744; 3,576,743; 3,271,310; 3,444,170; 3,630,904; 3,272,746; 3,448,048; 3,632,510; 3,281,357; 3,448,049; 3,632,511; 3,306,908; 3,451,933; 3,697,428; 3,311,558; 3,454,607; 3,725,441; 3,316,177; 3,467,668; 4,194,886; 3,340,281; 3,501,405; 4,234,435; 3,341,542; 3,522,179; 4,491,527; 3,346,493; 3,541,012; RE 26,433.

The reaction products include amides, imides, amine and metal salts, esters, acides and mixtures thereof, including mixtures of discrete molecules of two or more of the types mentioned above, or mixtures wherein a single molecule contains various combinations of the above-described chemical types.

Of the above-described reaction products of carboxylic acids, certain members are preferred. The preferred product is that obtained by reaction of a carboxylic acid containing at least about 34, and preferably at least about 54 carbon atoms with an ethylene polyamine to form a nitrogen-containing product. Especially preferred is the reaction product of an alkenyl substituted succinic anhydride meeting the above requirements, with an ethylene polyamine (including cyclic nitrogen reactants such as piperazines). This reaction results in a mixture containing varying amounts, depending on reaction conditions, of amide, imide, amine salt, amide-salts, amide-acids, and various combinations thereof. Useful nitrogen-containing products may be obtained by post-treatment of esters, metal salts, residual-free acid, etc., with the above-described ethylene polyamine. A wide variety of the preferred nitrogen-containing product useful in the compositios of this invention are described in U.S. Pat. Nos. 3,272,746; 3,216,666; 3,172,892; 4,234,435; and numerous others.

(2) Reaction products of relatively high molecular weight aliphatic or alicyclic halides with amines, preferable polyalkylene polyamines. These may be characterized as "amine dispersants" and examples thereof are described for example, in the following U.S. Pat. Nos.: 3,275,554; 3,454,555; 3,438,757; 3,565,804.

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following are illustrative, U.S. Pat. Nos.: 3,413,347; 3,725,480; 3,697,574; 3,726,882; 3,725,277.

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.:

3,036,003; 3,282,955; 3,493,520; 3,639,242; 3,087,936; 3,312,619; 3,502,677; 3,649,229; 3,200,107; 3,366,569; 3,513,093; 3,649,659; 3,216,936; 3,367,943; 3,533,945; 3,658,836; 3,254,025; 3,373,111; 3,539,633; 3,697,574; 3,256,185; 3,403,102; 3,573,010; 3,702,757; 3,278,550; 3,442,808; 3,579,450; 3,703,536; 3,280,234; 3,455,831; 3,591,598; 3,704,308; 3,281,428; 3,455,832; 3,600,372; 3,708,522; 4,234,435.

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos.:

3,329,658; 3,666,730; 3,449,250; 3,687,849; 3,519,565; 3,702,300.

The above-noted patents are incorporated herein by reference for their disclosures of ashless dispersants.

When the above-described ashless dispersants of this invention are employed in the lubricatingn compositions of this invention, they can be used in amounts ranging from about 0.01 to about 50 percent by weight of the lubricating oil composition. More often, they are used in amounts ranging from about 0.5 to about 25 percent, preferably from about 0.5 to about 10 percent by weight. Most preferably, they comprise about 0.5 to about 5 percent by weight of the lubricating oil composition. Dispersants contining the succinimide group are especially preferred.

Other members of above-illustrated group of optional additives may each be present in lubricating compositions at a concentration of as little as 0.001 percent by weight usually ranging from about 0.01 percent to about 20 percent by weight. In most instances, they each may be present from about 0.1% to about 10% by weight.

The various additives described herein can be added directly to the lubricant. Preferably, however, they are diluted with a substantially inert, normally liquid organic diluent such as mineral oil, naphtha, benzene, toluene or xylene, to form an additive concentrate. These concentrates usually comprise about 0.1 to about 80% by weight of the compositions of this invention and may contain, in addition, one or more other additives known in the art or described hereinabove. Concentrations such as 15%, 20%, 30% or 50% or higher may be employed. These concentrates are then added to lubricating oils at levels adequate to provide the required degree of performance.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

The aliphatic hydrocarbon substituted aromatic hydrocarbon described herein is used in a minor amount with a major amount of an oil of lubricating viscosity to prepare the lubricating oils of this invention. A minor amount is less than 50 percent by weight of the total composition, whereas a major amount is more than 50 percent by weight of the composition. Thus, for example, 5, 10, 30 or 40 percent are minor amounts, while 51, 60, 70, 90, etc. percent are major amounts. The aliphatic hydrocarbon substituted aromatic hydrocarbons of this invention are generally used at levels from about 5 to 35 percent by weight, more often from about 5 to 10 percent by weight of the total composition. Thus, depending on the precise makeup of the aliphatic hydrocarbon substituted aromatic hydrocarbon, varying amounts of compounds of formula (I), wherein n is an integer between 1 and 6 and/or compounds of formula (II) are provided.

Compounds of formula I, wherein n is an integer between 1 and 6, more preferably I, are often present in concentrations ranging from about 1 to about 15 percent by weight, more preferably 2 to about 10 percent by weight. Most often these compounds are present in concentrations ranging between about 3 to about 5 percent by weight, all percentages being based on the total weight of the lubricating oil composition.

The lubricating compositions of this invention are illustrated by the examples in the following Table I. The lubricating compositions are prepared by combining the specified ingredients, individually or from concentrates, in the indicated amounts and oil of lubricating viscosity to make the total 100 parts by weight. All parts and percentages are by weight of the total composition unless otherwise indicated. Unless indicated otherwise, the amount of each listed additive is that of the neat additive, free of oil or other diluent. These examples are presented for illustrative purposes only, and are not intended to limit the scope of this invention.

TABLE I

| | Lubricant Examples | | |
|---|---|---|---|
| | 1 | 2 | 3 |
| Ashless dispersants derived from polyisobutenyl succinic anhydride | 4.13 | 3.34 | 1.88 |
| Metal salts of organic acids | 1.27 | 1.40 | 1.03 |
| Zinc salt of dihydrocarbon substituted dithiophosphoric acids | 1.34 | 1.01 | 1.23 |
| Basic calcium salt of sulfurized alkyl phenols | | 0.81 | 0.46 |
| Sulfurized Diels-Alder adduct | 0.2 | 0.20 | |
| Alkylated aryl amine | 0.16 | 0.17 | |
| Neutral calcium sulfonate | | | 0.17 |
| Fatty amide mixture | | 0.2 | |
| Silicone antifoam | 14 ppm | 15 ppm | 10 ppm |
| Hydrogenated styrene-butadiene copolymer | 1.07 | 1.6 | 1.44 |
| Commercial acrylate/methacrylate pour depressants | | 0.5 | |
| Styrene/maleate copolymer-amine reaction product | 0.08 | | 0.08 |
| Mineral oil | 61.82 | 77.7 | 86.15 |
| Synthetic (polyalphaolefin) oil | 24.3 | | |
| Aliphatic hydrocarbon substituted aromatic* | 5.63 | 8.4 | 7.56 |

*Heavy Alkylate - typical composition (parts by weight)
10% linear alkyl benzene
50% diphenyl alkane
30% dialkyl benzene
10% oligoalkyl benzene These lubricating oil compositions and similarly formulated lubricating oil compositions that did not contain the aliphatic hydrocarbon substituted aromatic hydrocarbon described herein were evaluated with respect to their ability to inhibit or to reduce the accumulation of black sludge in an internal combustion engine. Evaluations were conducted using modified Daimler-Benz M-102-E tests. The test engine is a gasoline fueled four cylinder, four-stroke, 2.3 liter fuel injected engine. In each case, the composition containing the aliphatic hydrocarbon substituted aromatic hydrocarbons of this invetion was found to be superior to a comparable oil composition that did not contain aliphatic hydrocarbon substituted aromatic hydrocarbons described herein.

The following Table II illustrates the superior performance of lubricating oil compositions of this invention compared to similar lubricating oil compositions which did not contain the heavy alkylate containing diphenylalkane (the compound of Formula I where n=1). The numerical rating system is from 1 to 10, where 10 indicates an engine free of black sludge. The higher the numerical rating, the better the performance of the lubricant with respect to inhibiting the formation and/or accumulation of black sludge.

The compositions containing diphenylalkane are those of Table I, items 1,2 and 3. Compositions A, B and C in Table II are similar to items 1, 2 and 3 respectively except that A, B and C do not contain heavy alkylate comprising diphenylalkane.

Lubricant set 1 and A, and set 2 and B were exposed to essentially the same test conditions except for test duration. Test duration for each lubricant set is shown in Table II. Lubricant set 3 and C was run under conditions more severe than those for set 1 and A.

TABLE II

| Lubricating Oil Composition | Test Duration hours | Results (Rating) |
|---|---|---|
| 1 | 150 | 9.7 |
| A | 150 | 9.4 |
| 2 | 225 | 8.1 |
| B | 225 | 7.4 |
| 3 | 150 | 8.9 |
| C | 150 | 7.8 |

The numerical ratings for compositions 1, 2 and 3 indicate a "Pass"result with respect to inhibition of black sludge formation and/or accumulation. The numerical ratings for compositions A, B and C are indicative of a "Fail"result.

What is claimed is:

1. In a lubricating oil composition which allows the accumulation of black sludge in a gasoline fueled internal combustion engine, the improvement which comprises incorporating into the lubricating oil composition a minor amount, effective to inhibit the accumulation of black sludge in said engine, of an aliphatic hydrocarbon substituted aromatic hydrocarbon which comprises of a composition of the formula $$Ar—R—(Ar)_n \quad (I)$$

wherein each Ar is independently an aromatic nucleus having from 0 to 3 substituents, R is a hydrocarbyl group, and n is an integer ranging from 1 to about 6, with the proviso that n does not exceed the available valences of R.

2. In the lubricating oil composition of claim 1 wherein the aliphatic hydrocarbon substituted aromatic hydrocarbon further comprises from about 1 to about 50 percent by weight of tetrahydronaphthalene or hydrocarbyl substituted tetrahydronaphthalenes.

3. In the lubricating oil composition of claim 1 wherein at least one Ar is a benzene ring having from 0 to 3 substituents.

4. In the lubricating oil composition of claim 1 wherein n is 1 or 2.

5. In the lubricating oil composition according to claim 1 wherein R contains from about 6 to about 30 carbon atoms.

6. In the lubricating oil composition according to claim 1 wherein each substituent is independently a hydrocarbyl based group having from about 6 to about 30 carbon atoms.

7. In the lubricating oil composition according to claim 5 wherein the aromatic nucleus is a benzene ring and n equals 1 or 2.

8. In the lubricating composition according to claim 7, which further comprises from about 0.5 to about 10 percent by weight of the reaction product of an alkyl or alkenyl substituted succinic anhydride or derivative thereof, wherein the alkyl or alkenyl group contains at least about 30 carbon atoms, with an ethylene polyamine.

9. A lubricating oil composition comprising a major amount of an oil of lubricating viscosity and a minor amount, effective to inhibit the accumulation of black sludge in a gasoline fueled internal combustion engine, of an aliphatic hydrocarbon substituted aromatic hydrocarbon which comprises a composition of the formula $$Ar—R—(Ar)_n \quad (I)$$

wherein each Ar is independently an aromatic nucleus having from 0 to 3 substituents, R is a hydrocarbyl group, and n is an integer ranging from 1 to about 6, with the proviso that n does not exceed the available valences of R.

10. The lubricating oil composition according to claim 9 wherein the aliphatic hydrocarbon substituted aromatic hydrocarbon comprises from about 1 percent to about 50 percent by weight of tetrahydronaphthalene or hydrocarbyl substituted tetrahydronaphthalenes.

11. The lubricating oil composition according to claim 9 wherein R contains from about 6 to about 30 carbon atoms.

12. The lubricating oil composition of claim 11 which further comprises an alkenyl arene-conjugated diene interpolymer.

13. The lubricating oil composition according to claim 11 wherein the aromatic nucleus is a benzene ring and n equals 1 or 2.

14. The lubricating oil of claim 13 which further comprises from about 0.5 to about 10 percent by weight of the reaction product of an alkyl or alkenyl substituted succinic anhydride or derivative thereof, wherein the alkyl or alkenyl group contains at least about 30 carbon atoms, with an ethylene polyamide.

15. A method for inhibiting the accumulation of black sludge in a gasoline fueled internal combustion engine, which method comprises lubricating said internal combustion engine with a lubricating oil composition comprising a minor amount, effective to inhibit the accumulation of black sludge in said engine, of an aliphatic hydrocarbon substituted aromatic hydrocarbon which comprises a composition of the formula $$Ar—R—(Ar)_n \quad (I)$$

wherein each Ar is independently an aromatic nucleus having from 0 to 3 substituents, R is a hydrocarbyl group, and n is an integer ranging from 1 to about 6, with the proviso that n does not exceed the available valences of R.

16. The method of claim 15 wherein the aliphatic hydrocarbon substituted aromatic hydrocarbon comprises from about 1 to about 50 percent by weight of tetrahydronaphthalene or hydrocarbyl substituted tetrahydronaphthalenes.

17. The method according to claim 15 wherein R contains from about 6 to about 30 carbon atoms.

18. The method according to claim 17 wherein the aromatic nucleus is a benzene ring and n equals 1 or 2.

19. The method according to claim 15 wherein the lubricating oil composition further comprises about 0.5 to about 10 percent by weight of the reaction product of an alkyl or alkenyl substituted succinic anhydride or derivative thereof, wherein the alkyl or alkenyl group contains at least about 30 carbon atoms, with an ethylene polyamine.

* * * * *

UNITED STATES PATENT AND TRADEMARK OFFICE

CERTIFICATE OF CORRECTION

PATENT NO. : 4,800,032

DATED : January 24, 1989

INVENTOR(S) : John P. Murphy

It is certified that error appears in the above-identified patent and that said Letters Patent is hereby corrected as shown below:

Column 3, line 51, after the word "substituents" and before the period, add a comma followed by the phrase --that is, it may contain from 0 to about 3 substituents--.

Column 3, line 59, after "expressly" and before "groups", insert --stated otherwise. Such substantially hydrocarbyl--.

Column 4, lines 35-39, delete the paragraph "It is readily apparent that, depending on the value of n, R will be a mono- or poly-valent group. As mentioned hereinabove, when n is 0 and R is an aliphatic hydrocarbon group. In this case, R is preferably an alkyl or alkenyl group.".

Column 5, line 51, after the word "substituents", and before the period, add a comma followed by the phrase --wherein the substituents are as identified hereinabove--.

UNITED STATES PATENT AND TRADEMARK OFFICE

CERTIFICATE OF CORRECTION

PATENT NO. : 4,800,032

DATED : January 24, 1989

INVENTOR(S) : John P. Murphy

It is certified that error appears in the above-identified patent and that said Letters Patent is hereby corrected as shown below:

Column 10, line 19, "lubricatingn" should be --lubricating--.

Column 11, line 6, "I" should be --1--.

Column 11, line 62, "invetion" should be --invention--.

Signed and Sealed this

Fifth Day of June, 1990

*Attest:*

*Attesting Officer*

HARRY F. MANBECK, JR.

*Commissioner of Patents and Trademarks*